US011419364B2

(12) United States Patent
Slate et al.

(10) Patent No.: US 11,419,364 B2
(45) Date of Patent: Aug. 23, 2022

(54) PEG SYSTEM FOR ORGANIZING CIGARS

(71) Applicants: Michael Slate, Indianapolis, IN (US); Ian Winston Scott Bennett, Indianapolis, IN (US)

(72) Inventors: Michael Slate, Indianapolis, IN (US); Ian Winston Scott Bennett, Indianapolis, IN (US)

( * ) Notice: Subject to any disclaimer, the term of this patent is extended or adjusted under 35 U.S.C. 154(b) by 0 days.

(21) Appl. No.: 17/203,916

(22) Filed: Mar. 17, 2021

(65) Prior Publication Data

US 2021/0195946 A1 Jul. 1, 2021

(51) Int. Cl.

| | |
|---|---|
| ***A24F 25/00*** | (2006.01) |
| ***A24F 15/02*** | (2006.01) |
| ***B65D 85/12*** | (2006.01) |
| ***B65D 25/08*** | (2006.01) |
| ***B65D 25/06*** | (2006.01) |

(52) U.S. Cl.

CPC ..... *A24F 25/00* (2013.01); *A24F 15/02* (2013.01); *B65D 25/06* (2013.01); *B65D 25/08* (2013.01); *B65D 85/12* (2013.01)

(58) Field of Classification Search

CPC ..... A24F 15/02; A24F 25/00; A24F 15/00; B65D 25/06; B65D 25/08; B65D 85/12

USPC ..... 206/256, 443, 446; 220/532, 533

See application file for complete search history.

(56) References Cited

U.S. PATENT DOCUMENTS

| | | | | |
|---|---|---|---|---|
| 3,656,786 A * | 4/1972 | Larson | A47F 3/12 | 211/184 |
| 3,680,177 A * | 8/1972 | Ginsberg | A47F 5/005 | 220/533 |
| 5,749,461 A * | 5/1998 | Guzman | B65D 85/12 | 206/256 |
| 7,341,148 B2 * | 3/2008 | Bettenhausen | A61L 2/18 | 206/439 |
| 8,210,355 B2 * | 7/2012 | Lee | C23C 14/50 | 206/562 |
| 8,381,912 B2 * | 2/2013 | Dalhamer | B65D 1/34 | 220/574 |

FOREIGN PATENT DOCUMENTS

| | | | |
|---|---|---|---|
| DE | 29715022 U1 * | 10/1997 | A24F 25/00 |

* cited by examiner

*Primary Examiner* — Bryon P Gehman
(74) *Attorney, Agent, or Firm* — Overhauser Law Offices, LLC

(57) ABSTRACT

The present invention discloses a peg system for modularly arranging cigars. The modular arrangement may include at least stacking the cigars and separating them from other cigars placed on the same tray. The peg system comprises a plurality of components including at least a wall and a connector. The wall fits into a connector gap of the connector to form the peg system. The peg system is removably attached to a tray by inserting a base of the connector into a tray gap of the tray. Thereafter, a plurality of cigars is stacked and separated on the tray by using the installed peg system on the tray.

15 Claims, 7 Drawing Sheets

PEG SYSTEM FOR ORGANIZING CIGARS

TECHNICAL FIELD OF THE INVENTION

The present invention relates in general to the field of a modular furniture, and, more particularly, to a peg system for modularly arranging cigars on a tray. The modular arrangement may include at least stacking the cigars and separating them from other cigars placed on the same tray.

BACKGROUND OF THE INVENTION

Over the past several years, cigar smoking has become increasingly popular. Cigars are enjoyed in a variety of ways, including after a meal, with coffee, and especially with an alcoholic beverage such as wine, liquor, or an aperitif. Generally, the cigars are stored in a suitable storage environment, otherwise, the cigars will dry, and become tasteless, and hence the cigars will not be suitable for smoking. Cigar storage and humidification devices are well documented in the prior art. The purpose of these devices is to maintain the freshness and humidity level of the cigars prior to their consumption. However, in many scenarios, it may be required to separate one type of cigars with other type of cigars, for example, a user may want to keep the new cigars separated from the old cigars. A simple way to achieve this is by using a separate humidor for the new cigars. However, this may cause an additional expense to the user. In some other scenarios, even if all the cigars were purchased together, the user may want to stack the cigars in one or more groups such that each group includes one or more cigars, and then separate each group from the other groups. The current humidor includes a tray without any stacking and separation mechanism. Thus, it is difficult for the user to achieve the stacking and separation of the cigars in the same humidor. Further, the stacking of different cigars together in the same humidor, in which the cigars are touching with each other, may cross contaminate flavor profiles of the cigars. Hence, separation of the cigars in the same humidor may be important. The purpose of the present invention is to provide a peg system for modularly organizing the cigars in the same humidor such that few of the cigars may be separately stacked from other cigars in the same humidor. It is to these ends that the present invention has been developed.

BRIEF SUMMARY OF THE INVENTION

To minimize the limitations in the prior art, and to minimize other limitations that will be apparent upon reading and understanding the present specification, the present invention describes a peg system for organizing cigars in a humidor. The humidor is a cigar cabinet that is configured to facilitate a modular arrangement of the cigars by using the peg system along with the humidification of the cigars when placed therein. The modular arrangement may include at least stacking the cigars and separating them from other cigars placed in the same humidor.

In one objective of the present invention, the peg system comprises a plurality of components including at least a wall and a connector. The wall fits into a connector gap of the connector to form the peg system. The peg system is removably attached to a tray by inserting a base of the connector into a tray gap of the tray. Thereafter, a plurality of cigars is stacked and separated on the tray by using the installed peg system on the tray. Here, the wall is a wooden panel that is designed to act as a separator for separating the cigars with other cigars on the same tray. The wall includes a cut-out portion at its bottom, and this cut-out portion is used for providing a tight fitting with the connector. Further, the connector is a fastener that is made up of a plastic material. The connector includes a first vertical portion and a second vertical portion. The connector further includes a circular base below the first vertical portion and the second vertical portion. Further, between the first vertical portion and the second vertical portion, there is the connector gap in which the wall is inserted such that a cut-out portion of the wall fits into the connector gap. The tray is a wooden tray.

In another objective of the present invention, the peg system for a humidor comprises a plurality of components including at least a wall and a connector. The wall fits into a connector gap of the connector to form the peg system. The peg system is removably attached to a tray of the humidor by inserting a base of the connector into a tray gap of the tray. Further, plurality of cigars is stacked and separated on the tray by using the installed peg system on the tray inside the humidor. Here, the wall is a wooden panel that is designed to act as a separator for separating the cigars with other cigars on the same tray inside the same humidor. The tray is a wooden tray. The wooden tray is a square or rectangular tray, and the cigars sit safely on top of the wooden tray.

Various advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

The novel features which are believed to be characteristic of the present invention, as to its structure, organization, use and method of operation, together with further objectives and advantages thereof, will be better understood from the following drawings in which a presently preferred embodiment of the invention will now be illustrated by way of various examples. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

Before describing the present invention in detail, it should be observed that the present invention utilizes a combination of components, which constitutes a peg system for modularly arranging cigars in a humidor. The modular arrangement may include at least stacking the cigars and separating them from other cigars placed in the same humidor. Accordingly, the components have been represented, showing only specific details that are pertinent for an understanding of the present invention so as not to obscure the disclosure with details that may be readily apparent to those with ordinary skill in the art having the benefit of the description herein. As required, the detailed embodiments of the present invention are disclosed herein. However, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The words "comprising", "having", "containing", and "including", and other forms thereof, are intended to be equivalent in meaning and be open ended in that an item or items following any one of these words is not meant to be an exhaustive listing of such item or items or meant to be limited to only the listed item or items.

The peg system for modularly arranging the cigars in the humidor will now be described with reference to the accompanying drawings, which should be regarded as merely illustrative without restricting the scope and ambit of the present invention.

Figure 1:
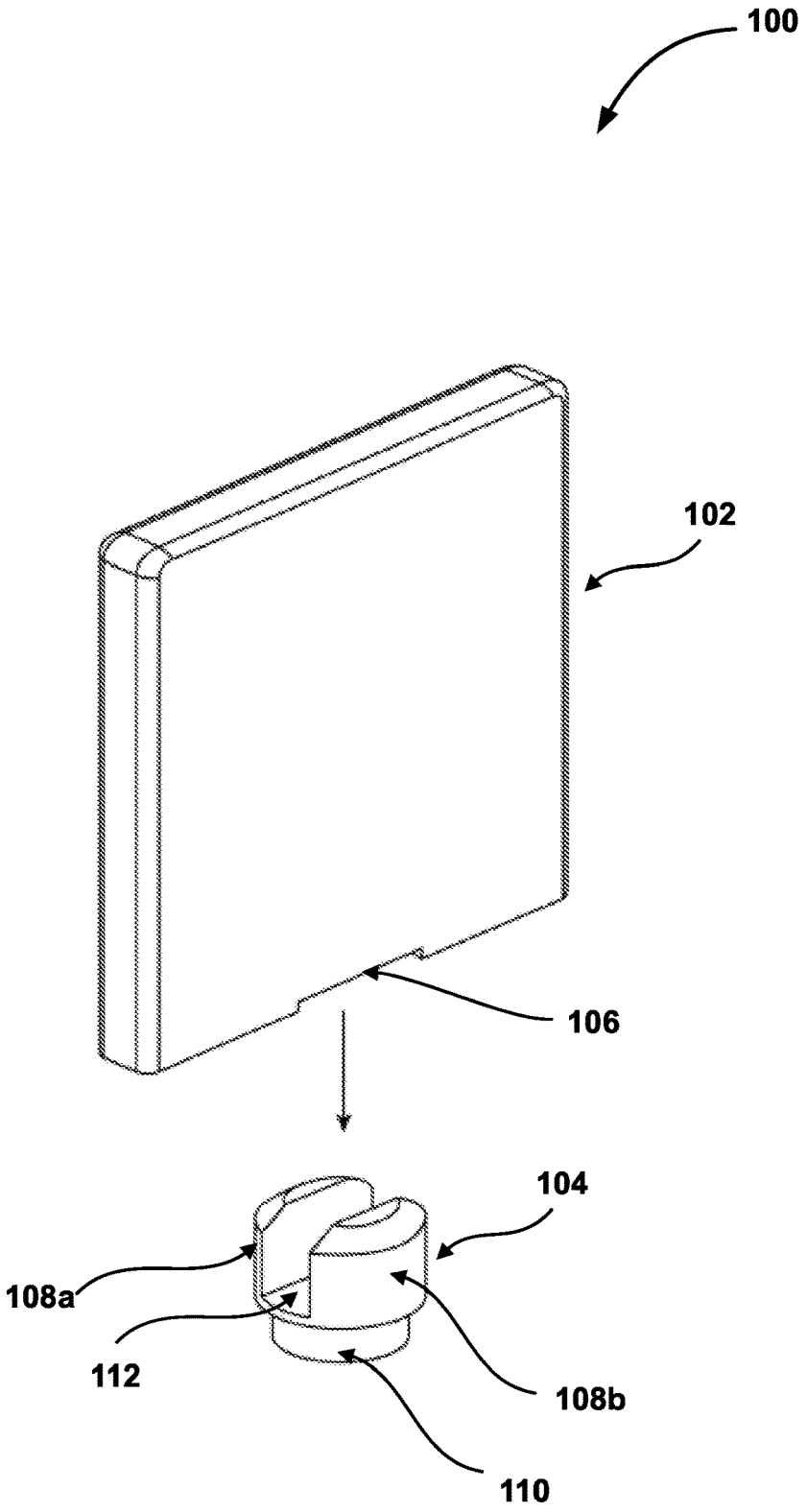
FIG. 1 is a diagram that illustrates a peg system, according to an exemplary embodiment of the present invention.

FIG. 1 is a diagram that illustrates a peg system 100, according to an exemplary embodiment of the present invention. The peg system 100 includes a plurality of components including at least a wall 102 and a connector 104. The wall 102 is a wooden panel (such as one that is made up of cedar wood without limiting the scope of the present invention) that is designed to act as a separator. The connector 104 is a fastener that is made up of a plastic material.

In an embodiment, the wall 102 may be a square or rectangular panel. Further, the wall 102 may include a cut-out portion 106 at its bottom. This cut-out portion 106 has been included to provide a tight fitting with the connector 104. In an embodiment, the connector 104 may be circular in design, however, a person having ordinary skills in the art would understand that the shape of the connector 104 is not limited to the circular shape, as shown herein. In some other scenarios, the connector 104 may be designed as square or rectangular based on the necessary requirements and applicability. The connector 104 may include a first vertical portion 108*a* and a second vertical portion 108*b*. Further, the connector 104 may include a circular base 110 below the first vertical portion 108*a* and the second vertical portion 108*b*. In between the first vertical portion 108*a* and the second vertical portion 108*b*, there is a gap 112 in which the wall 102 is inserted such that the cut-out portion 106 fits into the gap 112. In this way, the wall 102 is tightly connected to the connector 104.

Figure 2A:
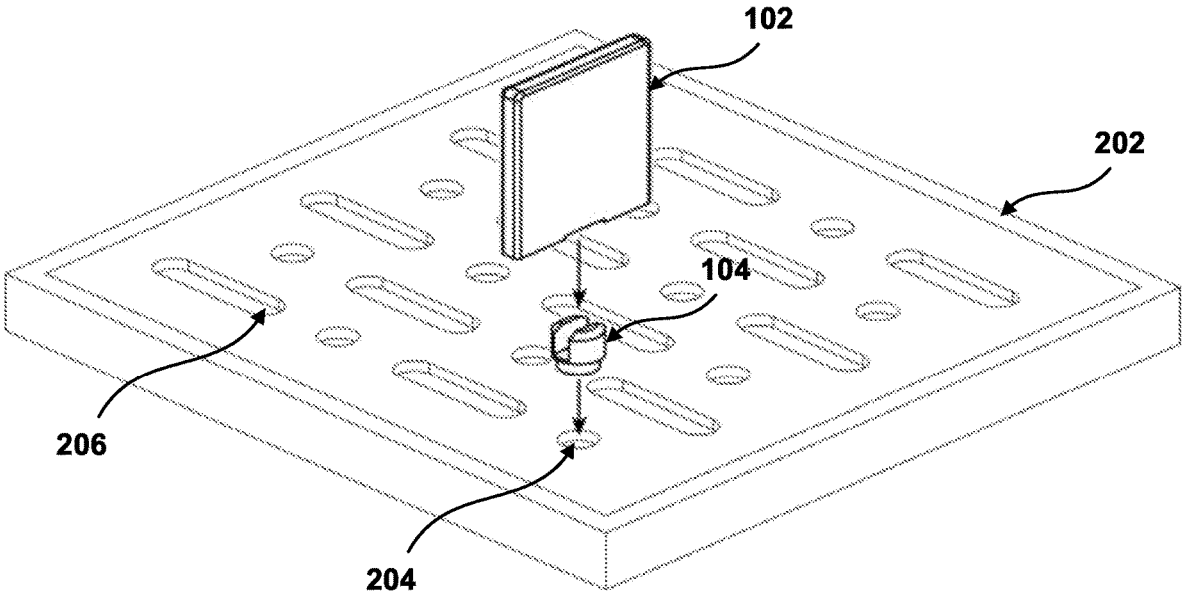
FIGS. 2A and 2B are diagrams that illustrate a mechanism for using the peg system with a tray, according to an exemplary embodiment of the present invention.
Figure 2B:
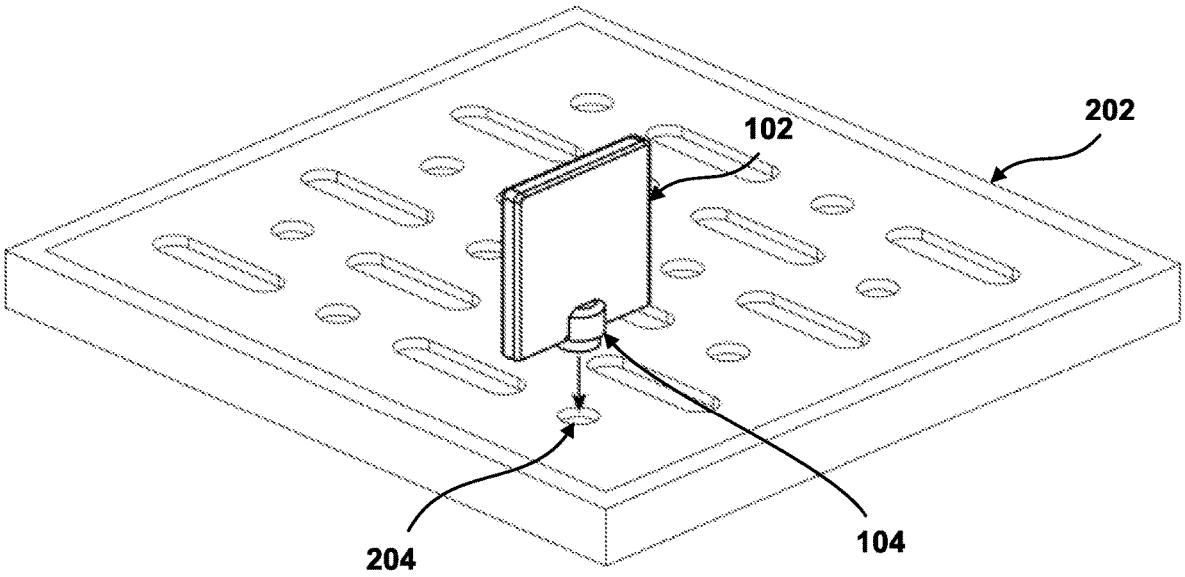

FIGS. 2A and 2B are diagrams that illustrate a mechanism for using the peg system 100 with a tray 202, according to an exemplary embodiment of the present invention. The tray 202 is a wooden tray or cover. The tray 202 may be made up of either mahogany or Spanish cedar wood but should not be construed as limiting to the scope of the present invention. In an exemplary embodiment, the wooden tray 202 may sit over a flat surface such as on top of a hydro tray of a humidor. In such scenarios, the wooden tray 202 may have two primary functions. Firstly, it creates a safe level of separation between the wood tray cover and the hydro tray so that the cigars can avoid contact with a gel solution that is inside the hydro tray. Secondly, it helps absorb humidity from the solution. In an embodiment, the wooden tray 202 may be a square or rectangular tray and the cigars sit safely on top of the wooden tray 202.

In an embodiment, the wooden tray 202 may include a plurality of symmetrical gaps or holes such as a circular gap or hole 204 and a cylindrical gap or hole 206. In an exemplary embodiment, these gaps or holes may permit moisture from the humidor solution to travel up to eventually be soaked up by the cigars placed on top of the wooden tray 202. In addition, the circular gap 204 may be used for inserting the circular base 110 of the connector 104 into it. For example, the circular base 110 of the peg system (including the fitted wall 102 and connector 104) may be inserted into the circular gap 204 and hence may create a barricade. This barricade formed by the wall 102 of the peg system may be utilized by a user to stack the cigars and keep it separately from other cigars on the same wooden tray 202.

Figure 3:
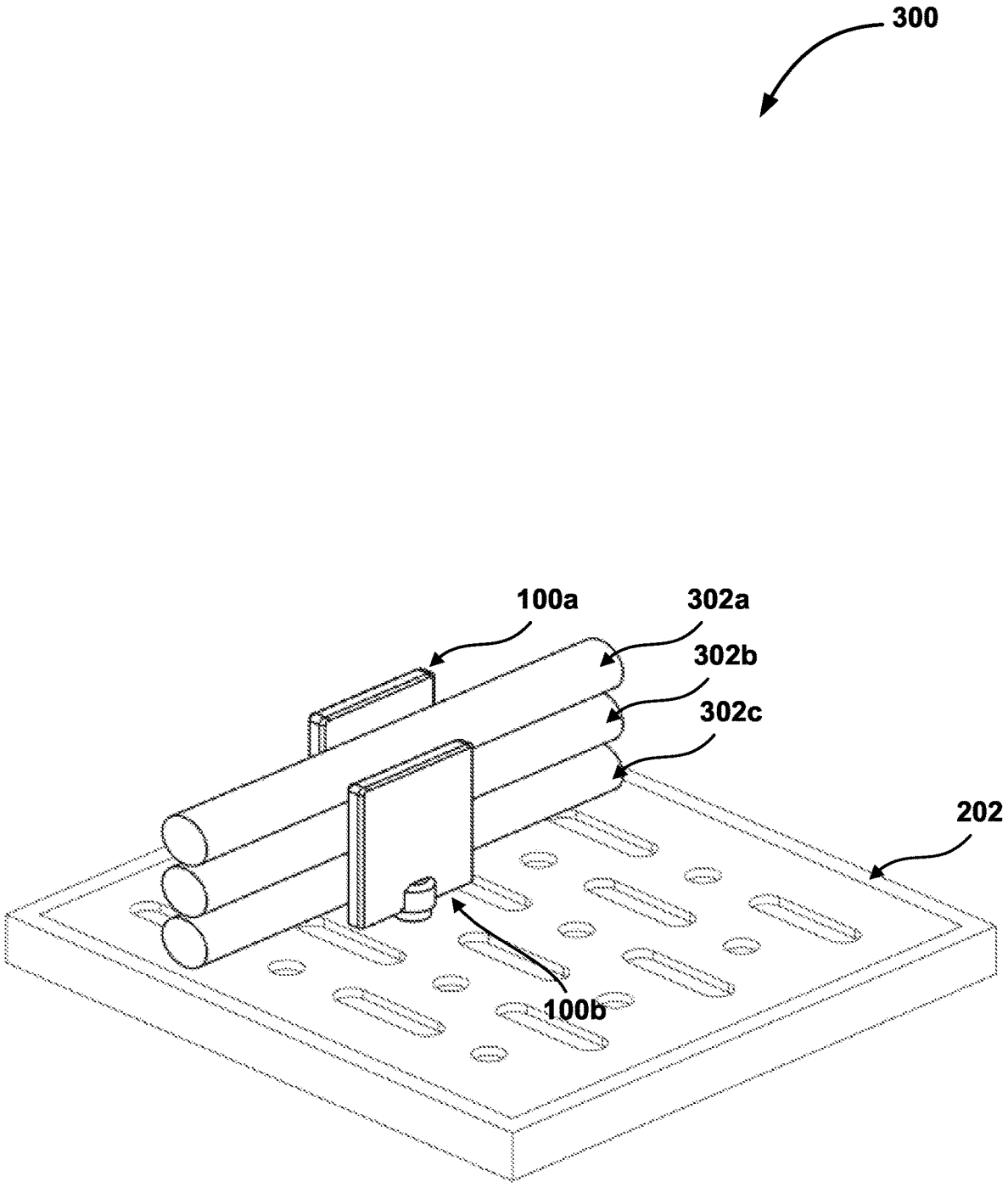
FIGS. 3, 4, and 5 are diagrams that illustrate various ways of modularly arranging the cigars on the tray by using a plurality of peg systems, according to an exemplary embodiment of the present invention.
Figure 4:
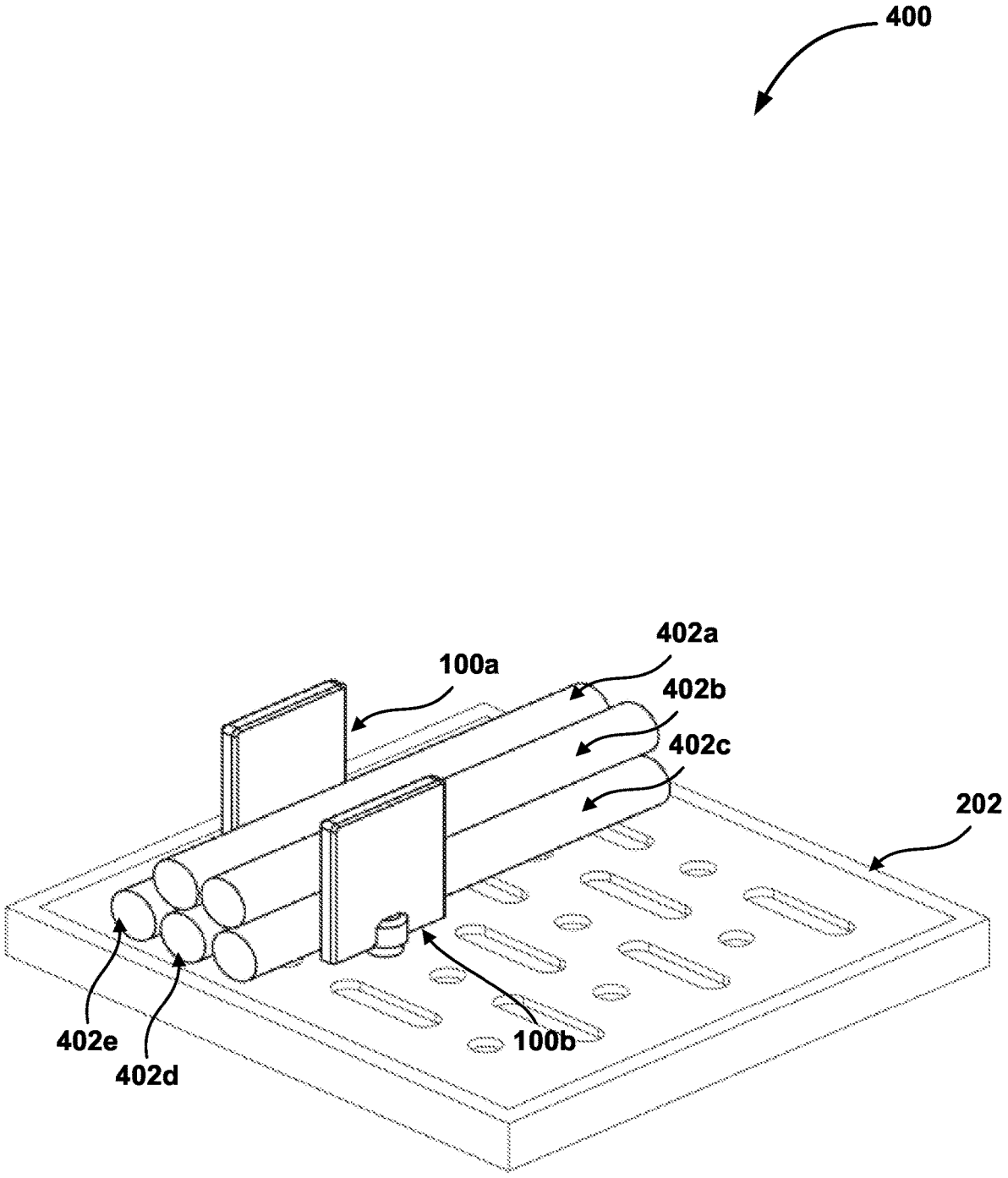
Figure 5:
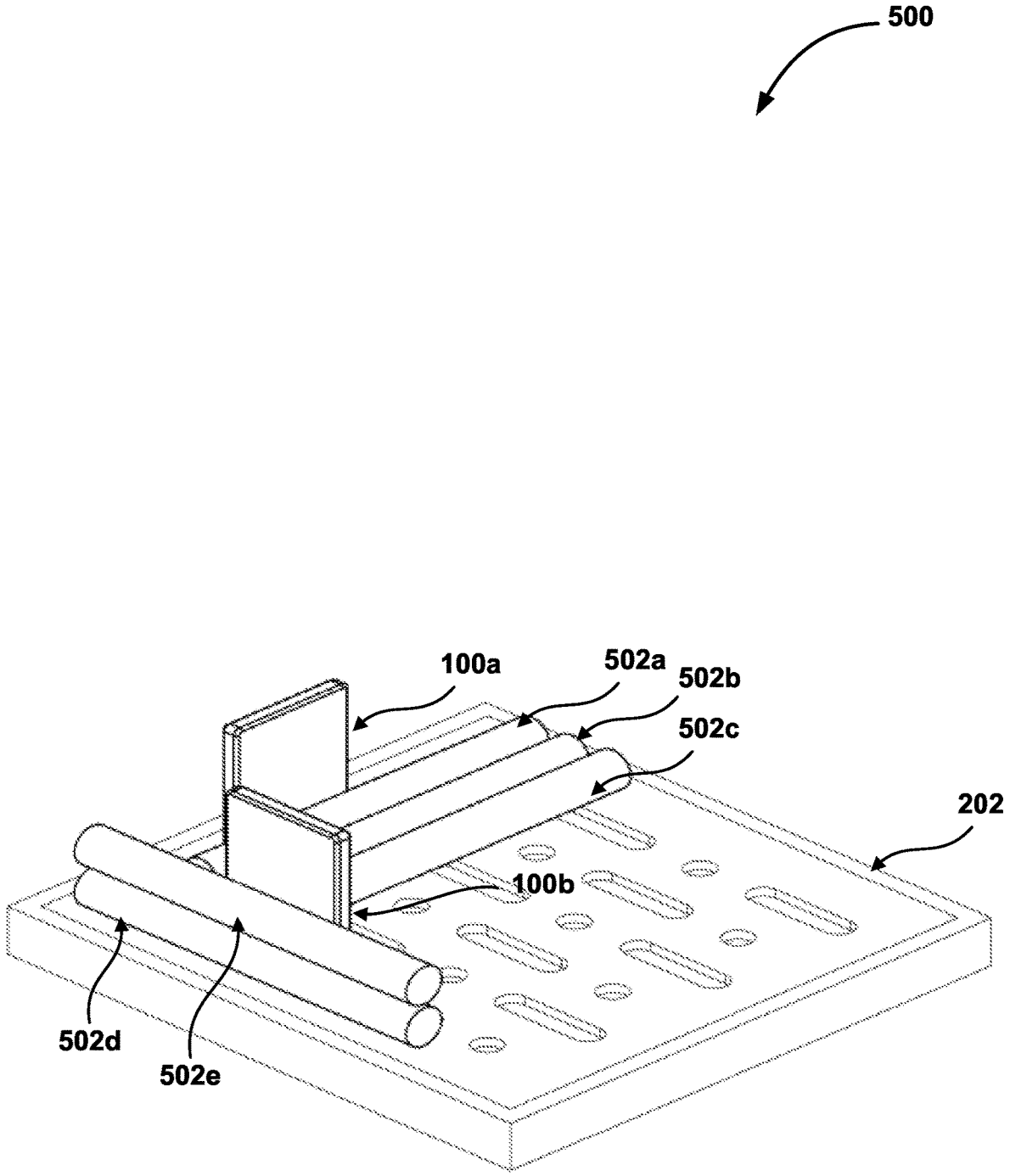

FIGS. 3, 4, and 5 are diagrams 300, 400, and 500 that illustrate various ways of modularly arranging the cigars on the tray 202 by using the plurality of peg systems 100*a* and 100*b*, according to an exemplary embodiment of the present invention.

In a first exemplary scenario, as shown in FIG. 3, each of the peg systems 100*a* and 100*b* (each peg system including the fitted wall 102 and connector 104) has been inserted into a respective circular gap on the wooden tray 202. The peg systems 100*a* and 100*b* have been installed on the wooden tray 202 such that they are parallel to each other as shown. Further, as shown in FIG. 3, the cigars 302*a*, 302*b*, and 302*c* have been stacked on top of each other between the peg systems 100*a* and 100*b*. In this case, the peg systems 100*a* and 100*b* have been installed on the wooden tray 202 such that it provides a tight stacking for the cigars 302*a*, 302*b*, and 302*c* on the wooden tray 202.

In a second exemplary scenario, as shown in FIG. 4, each of the peg systems 100*a* and 100*b* (each peg system including the fitted wall 102 and connector 104) has been inserted into a respective circular gap or hole on the wooden tray 202. The peg systems 100*a* and 100*b* have been installed on the wooden tray 202 such that they are parallel to each other as shown. Further, as shown in FIG. 4, the cigars 402*a*, 402*b*,

402*c*, 402*d*, and 402*e* have been stacked between the peg systems 100*a* and 100*b*. In this case, the peg systems 100*a* and 100*b* have been installed on the wooden tray 202 such that it provides a tight stacking for the cigars 402*a*, 402*b*, 402*c*, 402*d*, and 402*e* on the wooden tray 202 even when the cigars 402*a*, 402*b*, 402*c*, 402*d*, and 402*e* have been stacked along two layers as shown. Here, the gap between the peg systems 100*a* and 100*b* have been increased to accommodate at least three cigars between them.

In a third exemplary scenario, as shown in FIG. 5, each of the peg systems 100*a* and 100*b* (each peg system including the fitted wall 102 and connector 104) has been inserted into a respective circular gap on the wooden tray 202. The peg systems 100*a* and 100*b* have been installed on the wooden tray 202 such that they are perpendicular to each other as shown. Further, as shown in FIG. 5, the cigars 502*a*, 502*b*, 502*c*, 502*d*, and 502*e* have been stacked along the peg systems 100*a* and 100*b*.

Figure 6:
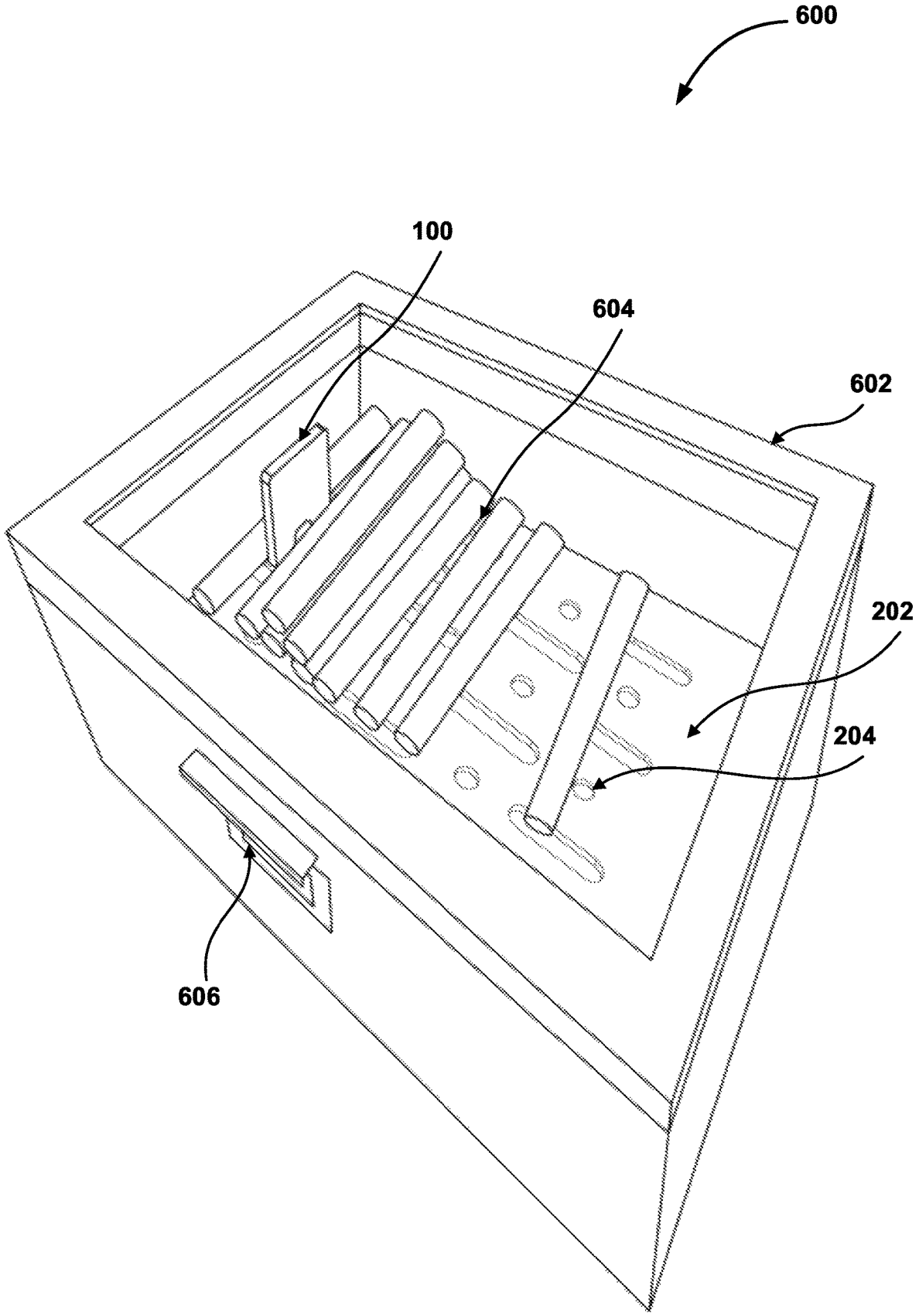
FIG. 6 is a diagram that illustrates a top view of a closed humidor with the peg system, according to an exemplary embodiment of the present invention.
Figure 7:
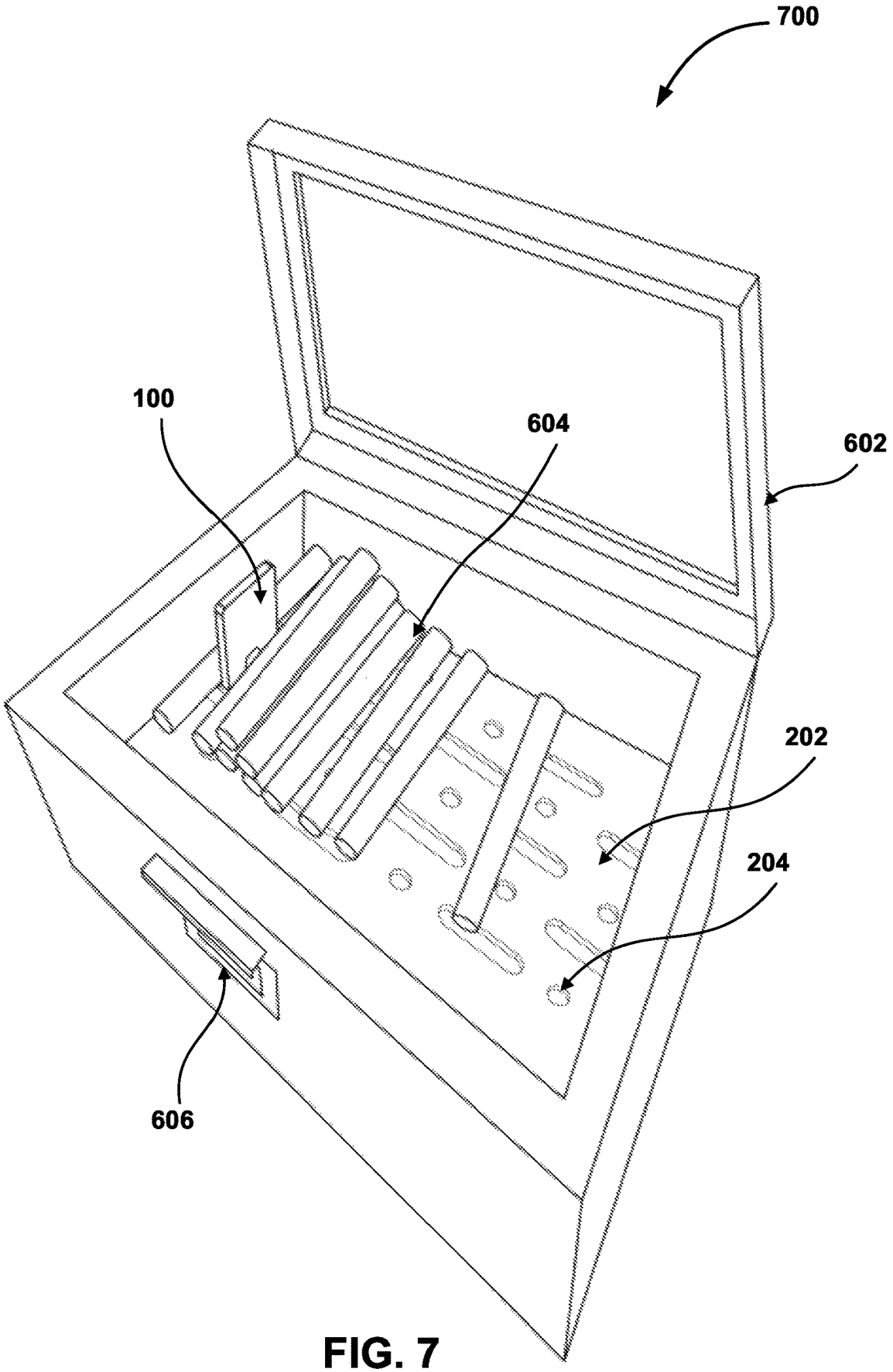
FIG. 7 is a diagram that illustrates a top view of an opened humidor with the peg system, according to an exemplary embodiment of the present invention.

FIG. 6 is a diagram 600 that illustrates a top view of a closed humidor 602 with the peg system 100, according to an exemplary embodiment of the present invention. FIG. 7 is a diagram 700 that illustrates a top view of an opened humidor 602 with the peg system 100, according to an exemplary embodiment of the present invention. The humidor 602 may be a glass top humidor or a non-glass top humidor. In certain embodiment, the glass top or the non-glass top may be separable from the humidor i.e., the glass top or the non-glass top may be removably attached or fixed to the humidor 602.

The humidor 602 is made up of a wooden material such as cedar wood or mahogany wood but should not be construed as limiting to the scope of the present invention. The humidor 602 is formed by assembling a system of components that help regulate the internal relative humidity of the humidor 602 to a defined range, thereby maintaining the suitable humidity environment for the cigars 604 placed inside the humidor 602. The shape and size of the humidor 602 may vary as per the requirement and preferences of a consumer.

The humidor 602 has been provided with a front digital hygrometer 606. In general, a hygrometer is a device that is used to measure the humidity in the air. A common way these devices work is by using a material that attracts moisture, and that changes depending on how moist it is. The digital hygrometer 606 of the humidor 602 is a gauge including one or more sensors that are used to measure the level of humidity. The digital hygrometer 606 may be used to measure humidity levels inside of cigar humidors such as the humidor 602. The digital hygrometer 606 is usually more accurate and reliable than an analog hygrometer.

In addition to the digital hygrometer 606, the front portion of the humidor 602 may also include a digital locking mechanism (not shown) for locking-unlocking the humidor 602, which in turn prevents unwanted access to the humidor 602 by other individuals such as kids. The digital locking mechanism may be designed based on one or more biometric data (such as fingerprints or facial expression) or a series of numerals.

As shown in FIGS. 6 and 7, the humidor 602 includes the wooden tray 202 having the gaps or holes such as the circular gaps or holes 204. Further, the peg system 100 has been installed into one of the circular gaps 204. Further, the cigars 604 have been stacked along the installed peg system 100. The cigars 604 have been placed on top of the wooden tray 202 as shown in FIGS. 6 and 7. After placing the cigars 604 on the wooden tray 202, the glass top of the humidor 602 is magnetically sealed over its lower portion. A person having ordinary skills in the art would understand that a user may install more than one peg systems and accordingly perform the stacking of the cigars as well as separation of one group of cigars with other groups of cigars without limiting the scope of the present invention.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

What is claimed is:

1. A peg system, comprising:
a plurality of components including at least:
a wall, and
a connector,
wherein the wall fits into a connector gap of the connector to form the peg system,
wherein the wall includes a cut-out portion at its bottom, and this cut-out portion is used for providing a tight fitting with the connector,
wherein the peg system is removably attached to a tray by inserting a base of the connector into a tray gap of the tray, and
wherein a plurality of cigars is stacked and separated on the tray by using the installed peg system on the tray.

2. The peg system of claim 1, wherein the wall is a wooden panel that is designed to act as a separator for separating the cigars with other cigars on the same tray.

3. The peg system of claim 1, wherein the connector is a fastener that is made up of a plastic material.

4. The peg system of claim 3, wherein the connector includes a first vertical portion and a second vertical portion.

5. The peg system of claim 4, wherein the connector further includes a circular base below the first vertical portion and the second vertical portion.

6. The peg system of claim 5, wherein, between the first vertical portion and the second vertical portion, there is the connector gap in which the wall is inserted such that a cut-out portion of the wall fits in to the connector gap.

7. The peg system of claim 1, wherein the tray is a wooden tray.

8. A peg system for a humidor, comprising:
a plurality of components including at least:
a wall, and
a connector,
wherein the wall fits into a connector gap of the connector to form the peg system,
wherein the wall fits into a connector gap of the connector to form the peg system,
wherein the wall includes a cut-out portion at its bottom, and this cut-out portion is used for providing a tight fitting with the connector,
wherein the peg system is removably attached to a tray of the humidor by inserting a base of the connector into a tray gap of the tray, and
wherein a plurality of cigars is stacked and separated on the tray by using the installed peg system on the tray inside the humidor.

9. The peg system of claim 8, wherein the wall is a wooden panel that is designed to act as a separator for separating the cigars with other cigars on the same try inside the same humidor.

10. The peg system of claim 8, wherein the connector is a fastener that is made up of a plastic material.

11. The peg system of claim 10, wherein the connector includes a first vertical portion and a second vertical portion.

12. The peg system of claim 11, wherein the connector further includes a circular base below the first vertical portion and the second vertical portion.

13. The peg system of claim 12, wherein, between the first vertical portion and the second vertical portion, there is the connector gap in which the wall is inserted such that a cut-out portion of the wall fits into the connector gap.

14. The peg system of claim 8, wherein the tray is a wooden tray.

15. The peg system of claim 14, wherein the wooden tray is a square or rectangular tray and the cigars sit safely on top of the wooden tray.

* * * * *